US005360199A

United States Patent [19]

Speier

[11] Patent Number: 5,360,199

[45] Date of Patent: Nov. 1, 1994

[54] BAR APPARATUS FOR REMOVING A METAL GRILLE FROM A BUILDING OPENING

[76] Inventor: Norman A. Speier, 4935 Bullard, Hartland, Mich. 48353-1318

[21] Appl. No.: 40,149

[22] Filed: Mar. 30, 1993

[51] Int. Cl.[5] ..... B66F 3/00

[52] U.S. Cl. ..... 254/129; 254/131

[58] Field of Search ..... 254/131, 129, 94; 294/17

[56] References Cited

U.S. PATENT DOCUMENTS

| | | | |
|---|---|---|---|
| 1,096,378 | 5/1914 | Lawrence | 294/17 |
| 2,162,668 | 6/1939 | Stocker | 254/131 |
| 2,539,231 | 1/1951 | Davis | 294/17 |
| 2,769,236 | 11/1956 | Phillips et al. | 254/131 |
| 2,793,424 | 5/1957 | Witte | 254/131 |
| 2,832,628 | 4/1958 | Turnbull | 294/17 |
| 4,991,893 | 2/1991 | Gordon et al. | 294/17 |
| 5,165,661 | 11/1992 | Wright | 254/131 |

FOREIGN PATENT DOCUMENTS

| | | | |
|---|---|---|---|
| 746380 | 11/1966 | Canada | 254/131 |

*Primary Examiner*—Robert C. Watson

[57] ABSTRACT

Bar apparatus for removing a grille from a building opening either by pulling the grille away from the opening or pushing it toward the opening. The bar apparatus includes an elongated steel bar, a heel plate formed with a convex surface with a tubular socket for receiving the end of the bar, and a chain having a length sufficient to be wrapped around a grille bar and having its ends connected to the heel structure about 6 inches from the end of the bar. The user can then mount the heel structure on the building frame, wrap the chain around the grille, and then, by pivoting the grille bar about the heel structure, apply sufficient leverage so as to produce relative motion between the grille bar and the frame in which it is mounted.

1 Claim, 2 Drawing Sheets

BAR APPARATUS FOR REMOVING A METAL GRILLE FROM A BUILDING OPENING

BACKGROUND OF THE INVENTION

This invention is related to tools for removing a grille from a window or door opening, such as during a fire or other emergency, when the occupants of the building must exit through the opening.

Residents of many major cities commonly install steel grilles over building openings to prevent burglars and other unauthorized persons from entering the building. A problem sometimes occurs when a fire or other catastrophe arises in the building and the occupants are unable to exit either through a window opening having a grille or through a door opening having a grille locked closed.

Firemen frequently use pinch bars, a 6 foot long tapered bar to tear the grille from the opening. This tool is usually ineffective because the user cannot obtain sufficient leverage between the grille and the frame to remove the grille. The end of the bar digs into the wooden frame around the window rather than loosening the grille.

A similar type of tool is a lumber peavey, a stout lever having a hinged metal hook, however, the end of the lever is usually pointed so that it cannot function for removing a grille because the end of the lever would dig into the frame.

SUMMARY OF THE INVENTION

The broad purpose of the present invention is to provide an improved tool for removing a grille from a building opening, and a method for using such a tool. The preferred embodiment of the invention has a steel tubular body about 7 inches long, adapted to receive the end of a fireman's steel pinch bar or any other suitable bar. A spacer can be employed for bars having a smaller diameter. A convexly curved heel plate is attached to the body such that when the heel plate is placed on a window frame, the outer end of the bar can be swung about the heel plate. The heel plate is 6 inches wide and formed with a 5 inch radius.

A hook is linked to the tubular body for receiving a grille bar in such a manner that as the bar is swung about the heel plate, the hook pulls the grille away from the window opening.

The hook can be attached directly to the grille in one embodiment of the invention. In another embodiment, a chain about 30 inches long is wrapped around the grille. The chain ends are connected to the tubular body so that the grille is pulled as the bar is being pivoted about the heel plate.

Another use of the invention is to place the heel plate directly on the grille. The hook is anchored to the grille bar adjacent the frame in such a manner that as the pinch bar is swung about the heel plate, the heel plate pushes in the grille. This procedure is effective for dislodging a barrier in a building opening such as a door.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
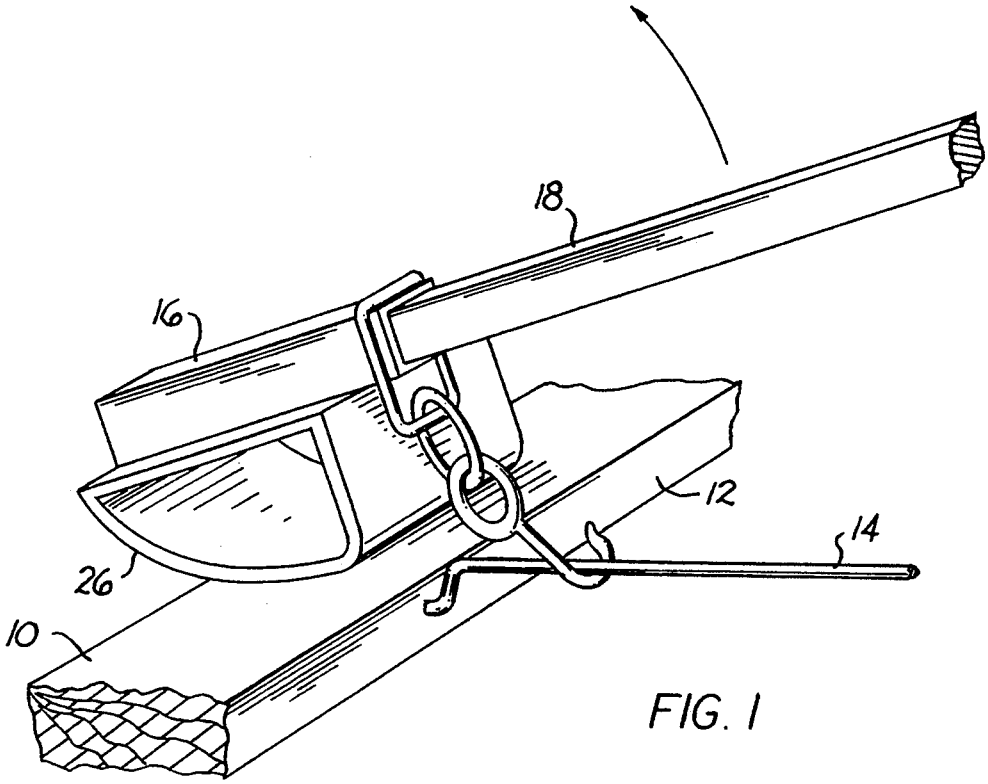
FIG. 1 illustrates a preferred bar apparatus useful for pulling a grille away from the window frame.

Referring to the drawings, FIG. 1 illustrates a portion of a hard wood window frame 10 of a building. The frame defines an opening 12. A portion of a conventional burglar proof steel grille structure 14 is mounted in the opening and attached to the sides of the frame. Similar grilles are also used for ornamental purposes in many foreign countries. This structure is well known to those skilled in the art.

The preferred embodiment of the invention comprises a heel structure 16 and a fireman's pinch bar 18. Other similar bars can also be employed as a lever. The pinch bar is about 6 feet long. Bar 18 has a square cross section with $1\frac{1}{4}$ inch sides.

Heel structure 16 includes a steel tubular body 20 having a square opening 22 for receiving the end of pinch bar 18. The body 16 is $7\frac{1}{2}$ inches long and has an outer diameter of $1\frac{1}{2}$ inches.

Figure 3:
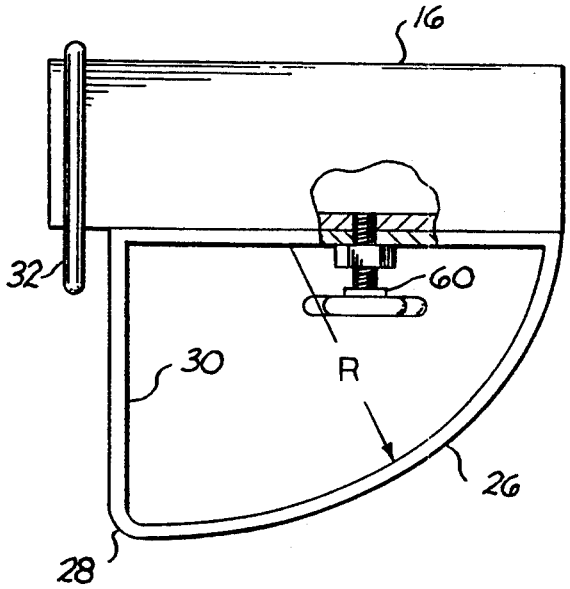
FIG. 3 is a side view of the heel structure.

A curved steel heel plate 26 has one end welded to the lower end of tubular body 16 to form a seat in the body for the end of the pinch bar. Heel plate 26 is formed on a curve, having a radius "R" of about 6 inches. The heel plate, as viewed in FIG. 3, is formed with a heel 28 and a linear section 30. Heel 28 is about $4\frac{3}{4}$ inches from body 16. Linear section 30 is perpendicular to the length of body 16. The upper end of the linear section is welded to the body at a point about 6 inches from the right end of the body as viewed in FIG. 3. The heel plate has a width of about 6 inches, that is several inches wider than the width of body 16 and the pinch bar. The heel plate provides a substantial surface for bearing against a window frame or the like. Further, it forms a convex bearing surface for pivoting the pinch bar about the grille.

A rectangular steel ring 32 receives the open end of body 16 and has its upper edge and sides welded around opening 22 of the tubular body. The lower end of the ring forms an eye 34 extending below the opening. An elongated metal link 36 is coupled to the eye.

A hook 38 has an eye 40 coupled with the link so that the bight 42 of the hook is free to move with respect to the heel plate.

The lower end of the hook can be swung several inches from heel 28. The hook has an opening sufficient to receive the bar of grille structure 14.

A threaded rod 60 is mounted on the body for locking the bar in the body.

Figure 2:
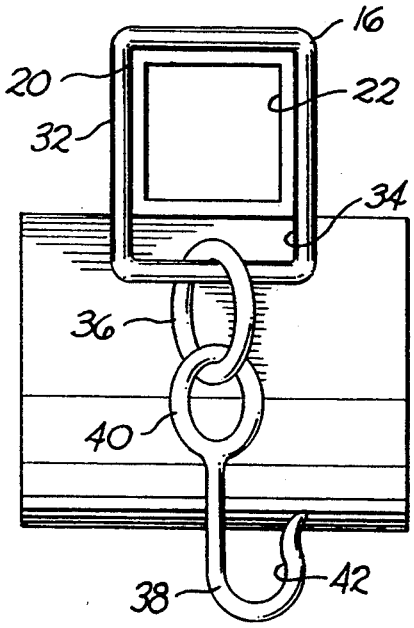
FIG. 2 is a view of the open end of the bar receiving opening.
Figure 5:
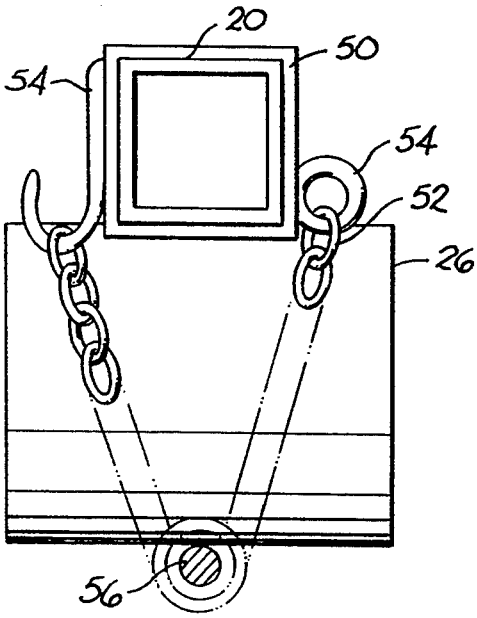
FIG. 5 is a view of another embodiment of the invention.

FIG. 5 illustrates a modified form of the invention. In this case the ring 32 illustrated in FIG. 2 is replaced by a ring 50 welded around the opening of tubular body 20. A chain 52 about 30 inches long has one link 54 welded to the side of ring 50. A hook 54 is welded to the opposite side of ring 50. The chain has a sufficient length so that it can be wrapped around a grille bar 56 and then the outer link of the chain slipped over the hook 54 to form a movable connection with respect to the heel structure. The Chain provides means for accommodating one or more grill bars of different sizes. In other words, it makes it easier for the user to connect the heel structure to the grill. The chain could be replaced by a steel cable or other flexible connecting means.

Figure 6:
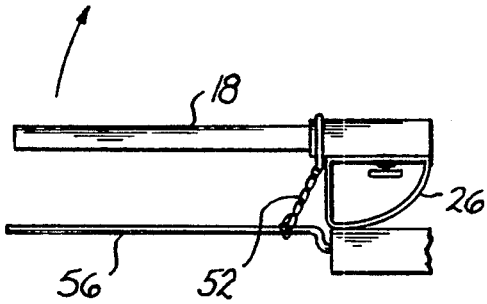
FIG. 6 illustrates the manner in which the invention is used to pull a grille from its anchored position in a window opening.

Referring to FIGS. 1 and 6, one method for using the improved bar structure is to mount the heel structure on window frame 10. The hook or chain engages grille bar 14. The user then pivots the pinch bar about the heel plate with sufficient leverage to pull the grille structure away from the window opening. The large surface area of the heel plate permits the bar to be swung about the heel plate without digging into the wooden frame. The users lifting effort is effectively applied to the grille bar.

Figure 4:
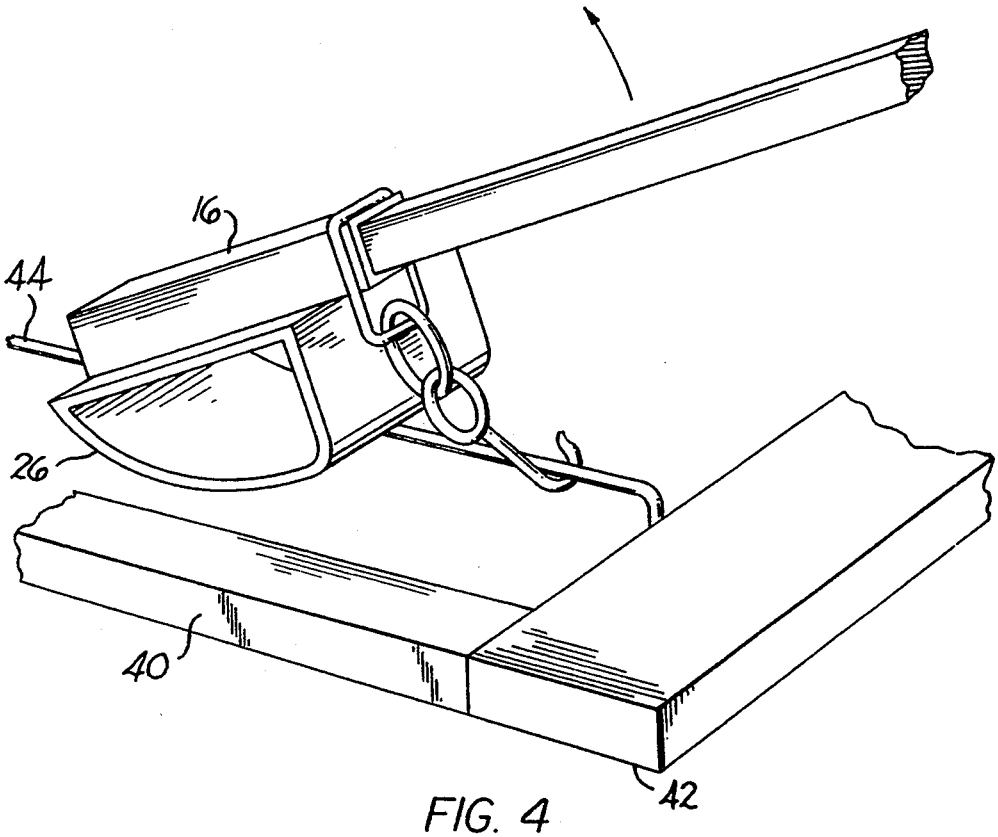
FIG. 4 is a view illustrating the manner in which the apparatus can be used to push a grille in toward the building opening.

FIG. 4 shows another manner in which the apparatus can be employed. In this case, the user is concerned with removing a door structure 40 mounted in frame 42. He desires to cave-in or push the door in sufficiently so that the locking structure can be pried from the door jamb. In this case, he mounts the heel plate on grille bar 44. Bar 44 is typical of several bars mounted on the door opening. The user then engages the hook or the chain, as the case may be, around the bar adjacent the frame and proceeds to pivot the bar in the direction of the arrow. As he pivots the outer end of the bar away from the door opening, the lower end of bar, together with the heel plate will swing about the hook and cave-in both the grille and the door.

Having described my invention, I claim:

1. Heel structure for use with a bar having first and second ends, comprising:

a heel element having a generally elongated, convex curved surface;

a tubular socket structure attached to the heel element so as to be movable therewith, the tubular socket structure having an opening for receiving the first end of a bar having first and second ends, to a position in the socket structure that is in near proximity to the convex curved surface of the heel element and in which the curved surface of the heel element is on one side of the bar;

a hook attached to the socket structure;

a multiple link chain having a first link connected to the socket structure, and a second link, spaced from the first link, and having a length sufficient to engage an object, the second link receiving the hook whereby the user can rock the second end of the bar about the heel element when the heel element is supported on a supporting surface that is relatively movable with respect to said object to induce relative movement between the object and the supporting surface.

* * * * *